US011423719B2

(12) United States Patent
Tiwari et al.

(10) Patent No.: US 11,423,719 B2
(45) Date of Patent: Aug. 23, 2022

(54) SYSTEM AND METHOD FOR SEAMLESS ACCESS AND INTENT IDENTIFICATION USING MOBILE PHONES

(71) Applicant: Carrier Corporation, Palm Beach Gardens, FL (US)

(72) Inventors: Ankit Tiwari, South Windsor, CT (US); Pedro Fernandez-Orellana, Shanghai (CN); Kunal Srivastava, Newington, CT (US); Paul C. O'Neill, New Britain, CT (US); Adam Kuenzi, Silverton, OR (US); Yuri Novozhenets, Pittsford, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/049,895

(22) PCT Filed: Apr. 22, 2019

(86) PCT No.: PCT/US2019/028435

§ 371 (c)(1),
(2) Date: Oct. 22, 2020

(87) PCT Pub. No.: WO2019/209670

PCT Pub. Date: Oct. 31, 2019

(65) Prior Publication Data

US 2021/0142600 A1 May 13, 2021

(30) Foreign Application Priority Data

Apr. 25, 2018 (CN) ..... 201810382442.5

(51) Int. Cl.
*G07C 9/00* (2020.01)

(52) U.S. Cl.
CPC ..... *G07C 9/00309* (2013.01)

(58) Field of Classification Search
CPC ..... G07C 9/00309
See application file for complete search history.

(56) References Cited

U.S. PATENT DOCUMENTS 9,384,607 B1 7/2016 Copeland et al.
9,483,887 B1 11/2016 Soleimani
(Continued)

FOREIGN PATENT DOCUMENTS

JP 2006348504 A 12/2006
WO 2013072489 A1 5/2013
WO 2016087541 A1 6/2016

OTHER PUBLICATIONS

Notification of Transmittal of the International Search Report for Application No. PCT/US2019/028435; Report Completed Date: Jul. 12, 2019; 6 pages.

(Continued)

*Primary Examiner* — Nabil H Syed
(74) *Attorney, Agent, or Firm* — Cantor Colburn LLP

(57) ABSTRACT

A method of actuating an access control is provided. The method including: detecting positional data of a mobile device carried by an individual; detecting that the mobile device is located within a zone of interest in response to positional data of the mobile device; detecting an access control; detecting intent of the individual carrying the mobile device to actuate the access control; authenticating the individual carrying the mobile device; and actuating the access control once the individual has been authenticated.

20 Claims, 3 Drawing Sheets

(56) References Cited

U.S. PATENT DOCUMENTS

| | | | | |
|---|---|---|---|---|
| 9,524,601 | B1 | 12/2016 | Dumas | |
| 10,573,106 | B1 * | 2/2020 | Brady | G06K 9/00771 |
| 2012/0218075 | A1 * | 8/2012 | Hill | G07C 9/27 340/5.61 |
| 2012/0316661 | A1 * | 12/2012 | Rahman | G06F 1/1694 700/94 |
| 2013/0176107 | A1 | 7/2013 | Dumas et al. | |
| 2014/0049361 | A1 | 2/2014 | Ahearn et al. | |
| 2014/0292481 | A1 | 10/2014 | Dumas et al. | |
| 2015/0161834 | A1 | 6/2015 | Spahl et al. | |
| 2016/0364927 | A1 * | 12/2016 | Barry | H04L 41/06 |
| 2017/0301166 | A1 * | 10/2017 | Earles | G06F 21/35 |
| 2018/0082502 | A1 * | 3/2018 | Browning | G07C 9/20 |
| 2018/0102008 | A1 | 4/2018 | Dupart et al. | |
| 2019/0287329 | A1 * | 9/2019 | Jonsson | G07C 9/00309 |
| 2020/0357213 | A1 * | 11/2020 | Kita | G06K 7/10 |

OTHER PUBLICATIONS

Written Opinion of the Internation Searching Authorithy for Application No. PCT/US2019/028435; Report Completed Date: Jul. 12, 2019; 10 pages.

Chinese Office Action for Application No. 201810382442.5; dated Apr. 6, 2022; 11 Pages.

* cited by examiner

SYSTEM AND METHOD FOR SEAMLESS ACCESS AND INTENT IDENTIFICATION USING MOBILE PHONES

CROSS-REFERENCE TO RELATED APPLICATIONS

This application is a National Stage Application of International Application No. PCT/US2019/028435 filed Apr. 22, 2019, which claims the benefit of Chinese Application No. 201810382442.5 filed Apr. 25, 2018, the disclosures of which are incorporated herein by reference in their entirety.

BACKGROUND

The subject matter disclosed herein generally relates to the field of access control systems, and more particularly to an apparatus and method for operating access control systems.

Existing access controls may allow an individual to unlock rooms/corridors via a mobile device however it is difficult to determine when the individual is located proximate to the room they intend to unlock, which may lead the device continuously searching for the lock to the room.

BRIEF SUMMARY

According to one embodiment, a method of actuating an access control is provided. The method including: detecting positional data of a mobile device carried by an individual; detecting that the mobile device is located within a zone of interest in response to positional data of the mobile device; detecting an access control; detecting intent of the individual carrying the mobile device to actuate the access control; authenticating the individual carrying the mobile device; and actuating the access control once the individual has been authenticated.

In addition to one or more of the features described above, or as an alternative, further embodiments may include: increasing a rate of a wireless signal advertised by at least one of the access control and the mobile device when the mobile device is detected within the zone of interest.

In addition to one or more of the features described above, or as an alternative, further embodiments may include: increasing a rate of wireless signal detection by at least one of the access control and the mobile device when the mobile device is detected within the zone of interest.

In addition to one or more of the features described above, or as an alternative, further embodiments may include: increasing a rate of wireless signal detection by at least one of the access control and the mobile device when the mobile device is detected within the zone of interest.

In addition to one or more of the features described above, or as an alternative, further embodiments may include that detecting intent of the individual carrying the mobile device to actuate an access control further includes: detecting at least one of a position of the mobile device, an activity of the mobile device, and a calendar on the mobile device; and determining intent of the individual in response to at least one of the position of the mobile device, the activity of the mobile device, and the calendar on the mobile device.

In addition to one or more of the features described above, or as an alternative, further embodiments may include that authenticating the individual carrying the mobile device further include: obtaining a credential from the mobile device; and verifying that the credential is authorized to actuate the access control.

In addition to one or more of the features described above, or as an alternative, further embodiments may include that authenticating the individual carrying the mobile device further includes: detecting at least one of a voice signature and a verbal command from the individual carrying the mobile device; and verifying that individual is authorized to actuate the access control in response to at least one of the voice signature and the verbal command.

In addition to one or more of the features described above, or as an alternative, further embodiments may include that authenticating the individual carrying the mobile device further includes: capturing one or more visual images of the individual carrying the mobile device; and verifying that individual is authorized to actuate the access control in response to the one or more visual images.

In addition to one or more of the features described above, or as an alternative, further embodiments may include that the one or more images depict at least one of a face of the individual carrying the mobile device and a gait of the individual carrying the mobile device.

In addition to one or more of the features described above, or as an alternative, further embodiments may include that the detecting positional data of a mobile device further include: determining a distance between the mobile device and the access control in response to a signal strength of a wireless signal advertised by at least one of the mobile device and the access control.

According to another embodiment, a computer program product tangibly embodied on a computer readable medium is provided. The computer program product including instructions that, when executed by a processor, cause the processor to perform operations including: detecting positional data of a mobile device carried by an individual; detecting that the mobile device is located within a zone of interest in response to positional data of the mobile device; detecting an access control; detecting intent of the individual carrying the mobile device to actuate the access control; authenticating the individual carrying the mobile device; and actuating the access control once the individual has been authenticated.

In addition to one or more of the features described above, or as an alternative, further embodiments may include that the operations further includes: increasing a rate of a wireless signal advertised by at least one of the access control and the mobile device when the mobile device is detected within the zone of interest.

In addition to one or more of the features described above, or as an alternative, further embodiments may include that the operations further include: increasing a rate of wireless signal detection by at least one of the access control and the mobile device when the mobile device is detected within the zone of interest.

In addition to one or more of the features described above, or as an alternative, further embodiments may include that the operations further includes: increasing a rate of wireless signal detection by at least one of the access control and the mobile device when the mobile device is detected within the zone of interest.

In addition to one or more of the features described above, or as an alternative, further embodiments may include that detecting intent of the individual carrying the mobile device to actuate an access control further includes: detecting at least one of a position of the mobile device, an activity of the mobile device, and a calendar on the mobile device; and determining intent of the individual in response to at least one of the position of the mobile device, the activity of the mobile device, and the calendar on the mobile device.

In addition to one or more of the features described above, or as an alternative, further embodiments may include that authenticating the individual carrying the mobile device further includes: obtaining a credential from the mobile device; and verifying that the credential is authorized to actuate the access control.

In addition to one or more of the features described above, or as an alternative, further embodiments may include that authenticating the individual carrying the mobile device further includes: detecting at least one of a voice signature and a verbal command from the individual carrying the mobile device; and verifying that individual is authorized to actuate the access control in response to at least one of the voice signature and the verbal command.

In addition to one or more of the features described above, or as an alternative, further embodiments may include that authenticating the individual carrying the mobile device further includes: capturing one or more visual images of the individual carrying the mobile device; and verifying that individual is authorized to actuate the access control in response to the one or more visual images.

In addition to one or more of the features described above, or as an alternative, further embodiments may include that the one or more images depict at least one of a face of the individual carrying the mobile device and a gait of the individual carrying the mobile device.

In addition to one or more of the features described above, or as an alternative, further embodiments may include that the detecting positional data of a mobile device further includes: determining a distance between the mobile device and the access control in response to a signal strength of a wireless signal advertised by at least one of the mobile device and the access control.

Technical effects of embodiments of the present disclosure include tracking a location, position, and movement of a mobile device relative to access controls in order to increase sensing rate when the mobile device is within the zone of interest.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
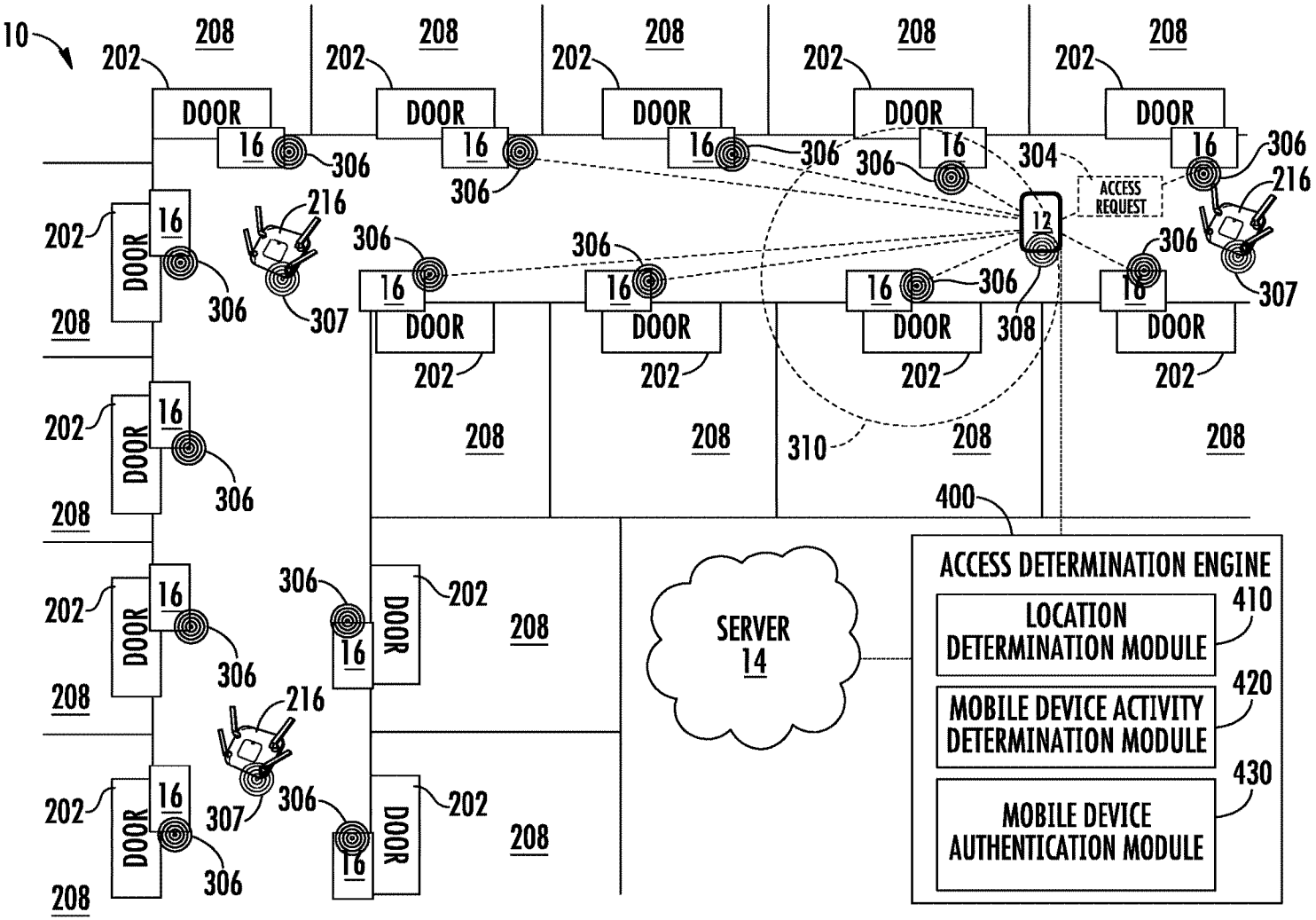
FIG. 1 illustrates a general schematic system diagram of an access control system, in accordance with an embodiment of the disclosure.

FIG. 1 schematically illustrates an access control system 10. The system 10 generally includes a mobile device 12, a server 14, a wireless access protocol device 216, and an access control 16. The access control system 10 may include any number of access controls 16. It should be appreciated that, although particular systems are separately defined in the schematic block diagrams, each or any of the systems may be otherwise combined or separated via hardware and/or software. In the illustrated embodiment, the access controls 16 may control access through a door 202 to a room 208. The access control system 10 may include any number of doors 202 and rooms 208. Further, there may be multiple doors 202 and access controls 16 for each room 208. It is understood that while the access control system 10 utilizes a door 202 and room 208 system for exemplary illustration, embodiments disclosed herein may be applied to other access control systems such as, for example, elevators, turnstiles, safes, etc.

A mobile device 12 belonging to an individual may be granted access to one or more access controls 16 (e.g. the door lock on an office or hotel room assigned to the individual). In one example, when an individual begins working at a new building their mobile device 12 will be granted access to particular rooms 208 where they are allowed to enter and/or work. In another example, when an individual checks into the hotel room their mobile device 12 will be granted access to a room 208. There may be one or more mobile devices 12 assigned to a room 208 (e.g. a husband and a wife in a hotel; or multiple workers in a collaborative workspace), thus embodiments disclosed herein may apply to multiple mobile devices 12 per room 208. An individual may utilize their mobile device 12 to unlock and/or lock the access control 16 operably connected to their assigned room 208 through an access request 304. The mobile device 12 may store credentials to unlock and/or lock the access control 16. Some credentials may be used for multiple access controls 16 if there are multiple access controls 16 for a single assigned room 208 or the individual is assigned access to multiple rooms 208. For example, an access control 16 operably connected to an individual's hotel room and an access control 16 operably connected to a hotel pool may respond to the same credential. Other credentials may be specific to a single access control 16.

Wireless communication may occur between the access control 16 and the mobile device 12 via short range wireless communication, such as for example Wi-Fi, Bluetooth, ZigBee, infrared, or any other short-range wireless communication method known to one of skill in the art. In an embodiment, the short-range wireless communication is Bluetooth. The mobile device 12 may have to be within a selected range of the access control 16 in order to utilize short-range wireless communication. For example, the selected range may be manually set by an individual as a chosen range or automatically set based on the limitations of hardware associated with the mobile device 12 and/or the access control 16.

Each access control 16 is a wireless-capable, restricted-access, or restricted-use device such as wireless locks, access control readers for building entry, and other restricted-use machines. The mobile device 12 submits credentials to the access controls 16, thereby selectively permitting a user to actuate (i.e., access or activate) functions of the access controls 16. A user may, for example, submit a credential to an electromechanical lock to unlock it, and thereby gain access to a room 208.

The mobile device 12 may transmit an access request 304 to the access control 16 by short-range radio transmission when the mobile device 12 is placed proximate the access control 16. The mobile device 12 is a wireless capable handheld device such as a smartphone that is operable to communicate with the server 14 and the access controls 16. The server 14 may provide credentials and other data to the access control 16, such as firmware or software updates to be communicated to one or more of the access controls 16. Although the server 14 is depicted herein as a single device, it should be appreciated that the server 14 may alternatively be embodied as a multiplicity of systems, from which the mobile device 12 receives credentials and other data. The access controls 16 may communicate directly with the server 14 or through the wireless access protocol devices 216 or through the mobile device 12.

The system 10 may include an access determination engine 400 configured to track a position of a mobile device 12, adjust the rate of sensing apparatus (i.e. the mobile device 12 and/or the access controls 16) when the mobile device 12 is within the zone of interest 310, detect a final destination access control 16, detect intent of the individual carrying the mobile device 12, authenticate a credential of the mobile device 12, and actuate the access control 16. The access determination engine 400 is comprised of modules including; a location determination module 410; a mobile device activity determination module 420; and a mobile device authentication module 430. Each module 410, 420, 430 may be located on either the mobile device 12, access control 16, or the server 14. Alternatively, the modules 410, 420, 430 may be distributed between the mobile device 12, access control 16, and the server 14.

The mobile device location determination 410 is configured to detect positional data of the mobile device 12. The position data may include the location of the mobile device 12 at various granularity levels including but not limited to a geographical coordinate, a building where the mobile device 12 is located, a section of the building where the mobile device 12 is located, a floor in the building where the mobile device 12 is located, a hallway in the building where the mobile device 12 is located, a room where the mobile device 12 is located, and a distance between the mobile device 12 and each of the access controls 16. For example, from the distance between the mobile device 12 and each of the access controls 16, a location within the system 10 (i.e. a building) may be determined, since the location of each access controls 16 is already known. The location of the mobile device 12 will be compared to zones of interest that have been saved in the zone determination engine 400. The zone of interest 310 may be an area around an access control 16 or a group of selected access controls 16 at a selected range, which may be a numerical radius round an access control (as shown in FIG. 1) or a designated location (e.g., a specific building, room, etc). The zone of interest 310 may vary in size depending on the mobile device 12. For example, the zone of interest 310 may be a geographical coordinate, a range away from a geographical coordinate, a building, a section of the building, a floor in the building, a hallway in the building, a room in the building, and a specific distance between the mobile device 12 and a specific access control 16. The mobile device 12 may have one or more zones of interest 310 depending on the access controls 16 that the mobile device 12 interacts with and/or may interact with. Each zone of interest 310 may be set manually by an individual using the mobile device 12 or may be learned through machine learning by tracking a location of the individual carrying the mobile device 12 over a period of time or commissioning period. In an embodiment, the zone of interest 310 may be established by GPS coordinates and then detected by the mobile device 12 using a GPS receiver 48. In another embodiment, the zone of interest 310 could be a wireless signal 306 that matches specific identifiers and when the signal strength of this wireless signal 306 is strong enough (i.e., above a threshold) and the identifiers match the expected information for a particular access control 16 then the mobile device 12 in the zone of interest 310.

An individual carrying a mobile device 12 may be tracked for a selected period of time, which may be referred to as the commissioning/learning period. During the commissioning period a plurality of data points are tracking including but not limited to each position of the mobile device 12, activity of the mobile device 12, interaction of the mobile device 12, and positional data of the mobile device 12 may be tracked and associated with a zone of interest 310. The mobile device 12 may have one or more zones of interest 310. Depending on the access controls 16 that the mobile device 12 interacts with and/or may interact with.

Alternatively, the positional data detected may be supplemented and/or replaced by positional data from a calendar of the individual carrying the mobile device 12. For example, the electronic calendar saved on the mobile device 12 may indicate that the individual is scheduled to be in a particular location at a specific time. In another example, the electronic calendar saved on the mobile device 12 may indicate that the individual has no meetings scheduled in a particular location at a specific time, the access control 16 may be prevented from opening at that particular location at the specific time. The positional data detected may also be supplemented by the time of the day. For example, an individual carrying a mobile device 12 may be determined to be leaving the building if the time indicates that work day of the individual is ending.

Once an individual carrying a mobile device is determined to be within a zone of interest 310 then the rate of sensing interactions between the mobile device 12 and access controls 16 located within the zone of interest 310 may be increased. For example, a zone of interest 310 may be determined to be within a building, so the rate at which the mobile device 12 attempts to detect the access controls 16 will begin or increase when mobile device 12 is within the building. Advantageously, by only starting detection or increasing the rate of detection when the mobile device 12 is within the zone of interest 310, the battery life of the mobile device 12 is conserved.

The mobile device activity determination module 420 uses an inertial measurement unit (IMU) sensor 57 (see FIG. 2) on the mobile device 12 to detect a position of the mobile device 12 (e.g., how the mobile device 12 is carried by the user: in a hand of an individual, in a back pocket of an individual, in a front pocket of an individual) and an activity of an individual carrying the mobile device 12 (e.g., sitting, standing, moving, slowing, accelerating, and stopping). The position or activity of the mobile device 12 may be indicative of intent of the individual. The IMU sensor 57 may be composed of one or more sensors including but not limited to an accelerometer and a light sensing. For example, the light sensor on the mobile device 12 may be used to determine if the mobile device 12 is in a pocket/bag or in hand and this information may be used to adjust for the signal strength. The mobile device activity determination module 420 may use the positional data of the mobile device 12, the position of the mobile device 12, and the activity of the mobile device 12 in order to determine an intent of the individual carrying the mobile device 12. In an example, intent may be the intension of the individual carrying the mobile device 12 to enter a specific door 202 operably connected to a specific access control. The location of the mobile device 12 may be further refined in response to the position of the mobile device 12 detected by the mobile device activity determination module 410 (e.g., a different location offset is applied if the mobile device 12 is in back pocket vs. front pocket of the individual carrying the mobile device 12). Knowing the position of the mobile device 12 is advantageous because the human body can cause interference in signal strength for wireless signals (e.g., Wi-Fi, Bluetooth, etc.), thus having the mobile device 12 in front or back pocket may cause the mobile device 12 to be in direct line of sight of the access control 16 or position an individual's body in between the mobile device 12 and the access control 16. Also advantageously, knowing the position of the mobile device 12 may help determine intent.

The mobile device authentication module 430 is configured to authenticate the individual carrying the mobile device 12 in a hands-free manner for the access control 16 where intent was determined. The mobile device authentication module 430 may authenticate an individual carrying the mobile device 12 by a passage and approval of a credential of the mobile device. The mobile device authentication module 430 may authenticate an individual carrying the mobile device 12 by detecting a voice signature of the individual, verbal command of the individual, and/or or a gait of the individual. The mobile device authentication module 430 may authenticate an individual carrying the mobile device 12 by an access timing history. The access timing history is a way to figure out if the individual is the owner of the mobile device 12. For example, in a normal routine an owner of the mobile device 12 accesses a specific access control 16 every day in the early morning, but the same owner is detected trying to access that specific access control 16 at midnight. Such behavior may be flagged as 'suspicious behavior' due to its variance away from the normal routine of the owner of the mobile device 12 and the access request 304 at midnight from owner of the mobile device 12 may be rejected due to the 'suspicious behavior'.

Once the individual carrying the mobile device 12 is authenticated, the access control 16 where intent was determined may be actuated (e.g., the door may be opened).

Alternatively, the intent detected may be supplemented and/or replaced by positional data from a calendar of the individual carrying the mobile device 12. For example, the electronic calendar saved on the mobile device 12 may indicate that the individual is scheduled to be in a particular location at a specific time and thus the individual intends to go to a specific access control 12.

The positional data of the mobile device 12 may be detected using one or more methods and apparatus. The positional data may be collected by the mobile device 12 and/or the server 14. The positional data may include a location of the mobile device 12 and/or a movement of mobile device 12 that is a derivative of a location of the mobile device 12, such as, for example, velocity, acceleration, jerk, jounce, snap . . . etc. The mobile device 12 may a determine positional data by the GPS 48, by the IMU sensor 57, wireless signal strength, and/or by triangulating wireless signals 307 from the wireless access protocol device(s) 216 or wireless signals 306 from the access control(s) 16. The location of the mobile device 12 may also be detected through triangulation of wireless signals emitted from the mobile device 12 or signal strength of wireless signals emitted from the mobile device 12. The location of the mobile device 12 may be detected using any other desired and known location detection/position reference means.

The access control 16 may be configured to continuously advertise a wireless signal 306 at various rates. The advertisement is the access control 16 declaring its presence to any nearby listening device and if it is a connectable advertisement it is an opportunity for another device (i.e., nearby mobile device 12) to connect to the access control 16. For example, the wireless signal 306 of the access control 16 may be a Bluetooth signal. The mobile device 12 is configured to detect the wireless signal 306 and determine positional data of the mobile device 12 in response to a signal strength of the wireless signal 306. In an embodiment, once the zones of interest 310 are determined, the mobile device 12 may only be configured to detect the wireless signal 306 of the access controls 16 when the mobile device 12 is within the zone of interest 310. In another embodiment, once the zones of interest 310 are determined, the mobile device 12 may increase the rate of attempts to detect the wireless signal 306 of the access controls 16 when the mobile device 12 is within the zone of interest 310. Advantageously, by increasing the rate of attempts to detect the wireless signal 306 of the access controls 16 when the mobile device 12 is within the zone of interest 310 the speed of interaction between the mobile device 12 and the access control 16 is also increased, thus communications between the access control 16 and the mobile device 12 will be made faster and access requests from the mobile device 12 to the access control 16 will be answered quicker.

Positional data of the mobile device 12 may also be determined using the wireless access protocol device 216. The wireless access protocol device 216 may be configured to advertise a wireless signal 307. The advertisement is the wireless access protocol device 216 declaring its presence to any nearby listening device and if it is a connectable advertisement it is an opportunity for another device (i.e., nearby mobile device 12) to connect to the wireless access protocol device 216. For example, the wireless signal 307 of the wireless access protocol device 216 may be a Wi-Fi signal. The mobile device 12 is configured to detect the wireless signal 307 and determine a positional data of the mobile device 12 in response to a signal strength of the wireless signal 307.

Positional data of the mobile device 12 may also be determined using the wireless access protocol device 216 and/or the access controls 16 to detect a wireless signal 308 advertised by the mobile device 12. The mobile device 12 may be configured to advertise a wireless signal 308. The advertisement is the mobile device 12 declaring its presence to any nearby listening device and if it is a connectable advertisement it is an opportunity for another device (i.e., access control 16 or wireless access protocol device 216) to detect this advertisement and triangulate the location of the mobile device 12. The wireless access protocol device 216 and/or the access controls 16 are configured to detect the wireless signal 308 and determine a positional data of the mobile device 12 in response to a signal strength of the wireless signal 308. The location of the mobile device 16 may be triangulated by relaying up to the location determination module 420 the strength of each wireless signal 308 detected and then the location determination module 420 can triangulate the position.

Wireless signal interaction data between the mobile device 12 and at least one of the access device 16 and the wireless access protocol device 216 may transmitted to the server 14 to determined positional data. In an embodiment, the location determination module 420 may be located on the server 14 and may be used to determine positional data. The server 14 may use signal strength detected between the mobile device 12, access controls 16, and the wireless access protocol device 216 to determine positional data of the mobile device 12.

Figure 2:
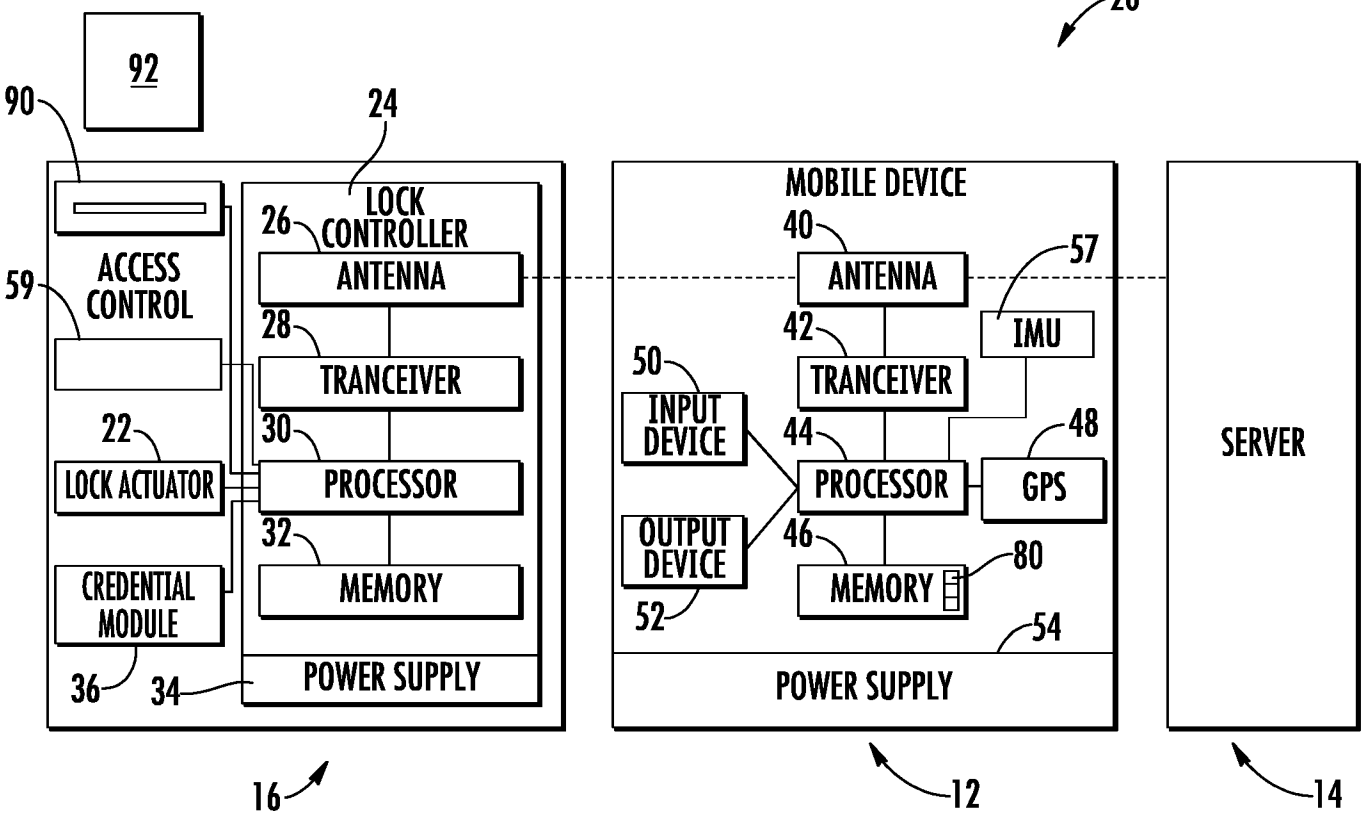
FIG. 2 illustrates a block diagram of an access control, mobile device and server of the access control system of FIG. 1, in accordance with an embodiment of the disclosure.

Referring now to FIG. 2 with continued reference to FIG. 1. FIG. 2 shows a block diagram of an example electronic lock system 20 includes the access control 16, the mobile device 12, and the server 14. The access control 16 generally includes a lock actuator 22, a lock controller 24, a lock antenna 26, a lock transceiver 28, a lock processor 30, a lock memory 32, a lock power supply 34, a lock card reader 90, and a credential module 36.

The access control 16 may have essentially two readers, one reader 90 to read a physical key card 92 and the credential module 36 to communicate with the mobile device 12 via the lock processor 30 and the transceiver 28 and antenna 26. In addition to utilizing the mobile device 12 to actuate the access control 16, a physical key card 92 may also be used to actuate the access control 16 by being inserted into the access control 16 for the access control 16 to read the physical key card 92 (e.g. a magnetic strip on an encoded card 92). The physical key card 92 is capable of being encoded with card data, such as, for example, a magnetic strip or RFID chip. The card data may include credentials to grant access to a specific access control 16. For example, for a period the mobile device 12 may be granted access to a specific access control 16, such as, for example, a period of stay/employment for the individual possessing the mobile device 12.

The access control 16 is responsive to credentials from the mobile device 12, and may, for example, be the lock of a turnstile or a door lock. Upon receiving and authenticating an appropriate credential from the mobile device 12 using the credential module 36, or after receiving card data from lock card reader 90, the lock controller 24 commands the lock actuator 22 to lock or unlock a mechanical or electronic lock. The lock controller 24 and the lock actuator 22 may be parts of a single electronic or electromechanical lock unit, or may be components sold or installed separately. In an embodiment, the access control 16 is composed of separate components—a reader (e.g., transceiver 28 and/or antenna 26) at a door 202, a processor 30 that gets the credential from the reader, and then a lock actuator 22 that gets a signal from the processor 30 to actuate an electromechanical lock.

The lock transceiver 28 is capable of transmitting and receiving data to and from at least one of the mobile device 12, the wireless access protocol device 216, and the other access controls 16. The lock transceiver 28 may, for instance, be a near field communication (NFC), Bluetooth, infrared, ZigBee, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate credentials and determine the access rights contained in the credentials or to pass messages from a transceiver to a credential module 36 and to receive a response indication back from the credential module 36. The lock memory 32 may be RAM, EEPROM, or other storage medium where the lock processor 30 can read and write data including but not limited to lock configuration options. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt).

While FIG. 2 shows the lock antenna 26 and the transceiver 28 connected to the processor 30, this is not to limit other embodiments that may have additional antenna 26 and transceiver 28 connected to the credential module 36 directly. The credential module 36 may contain a transceiver 28 and antenna 26 as part of the credential module. Or the credential module 36 may have a transceiver 28 and antenna 26 separately from the processor 30 which also has a separate transceiver 28 and antenna 26 of the same type or different. In some embodiments, the processor 30 may route communication received via transceiver 28 to the credential module 36. In other embodiments the credential module may communicate directly to the mobile device 12 through the transceiver 28.

The access control 16 may be in operably communication with a sensor system 59 including but not limited to a microphone, a camera, etc. The sensor system 59 may be located within the access control 16. The sensor system 59 is configured to help authentic the individual carrying the mobile device 12. A microphone of the sensor system 59 may be configured to detect a voice signature and/or a verbal command of the individual carrying the mobile device 12 and thus authentic the individual in response to the voice signature and/or the verbal command. A camera of the sensor system 59 may be configured to visually recognize a facial image of the individual carrying the mobile device 12 and thus authentic the individual in response to the facial image. The camera of the sensor system 59 may be configured to visually recognize a gait of the individual carrying the mobile device 12 and thus authentic the individual in response to the gait. In another embodiment, the sensors system 59 may be located within the mobile device 12. For example, the sensor system 59 may use the IMU sensor 57 of the mobile device 12 in order to detect the gait of the individual carrying the mobile device 12. Additionally, a microphone of the sensor system 59 may be the microphone of the mobile device, which may be configured to detect a voice signature and/or a verbal command of the individual carrying the mobile device 12 and thus authentic the individual in response to the voice signature and/or the verbal command.

The mobile device 12 generally includes a key antenna 40, a key transceiver 42, a key processor 44, a key memory 46, a GPS receiver 48, an input device 50, an output device 52, a key power supply 54, and an IMU sensor 57. The key transceiver 42 is a transceiver of a type corresponding to the lock transceiver 28, and the key antenna 40 is a corresponding antenna. In some embodiments, the key transceiver 42 and the key antenna 40 may also be used to communicate with the server 14. In other embodiments, one or more separate transceivers and antennas may be included to communicate with server 14. The key memory 46 is of a type to store a plurality of credentials locally on the mobile device 12. The mobile device 12 may also include a mobile device application 80. Embodiments disclosed herein, may operate through the mobile device application 80 installed on the mobile device 12. The IMU sensor 57 may be a sensor such as, for example, an accelerometer, a gyroscope, or a similar sensor known to one of skill in the art.

Figure 3:
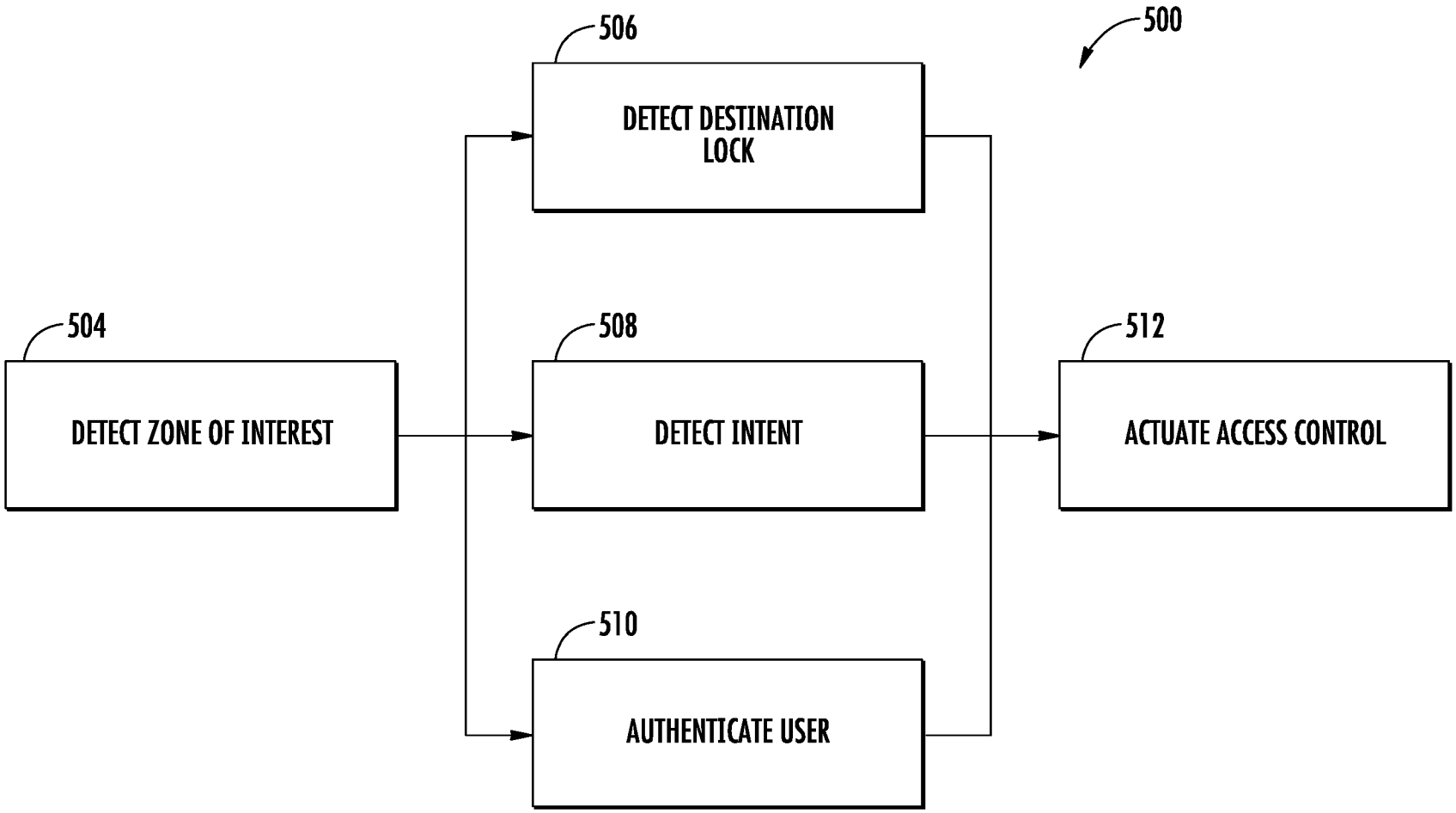
FIG. 3 is a flow diagram illustrating a method of actuating an access control using a mobile device, according to an embodiment of the present disclosure.

Referring now to FIG. 3 with continued reference to FIGS. 1-2. FIG. 3 shows a flow chart of a method 500 of actuating an access control 16 using a mobile device 12. The method 500 may be performed by the mobile device 12, access control 16, and/or the server 14. At block 504, positional data of a mobile device 12 carried by an individual is detected and it is determined that the mobile device 12 is located within a zone of interest 310 in response to positional data of the mobile device 12. Positional data of the mobile device 12 may be detected by determining a distance between the mobile device 12 and the access control 16 in response to a signal strength of a wireless signal advertised by at least one of the mobile device 12 and the access control 16. In an embodiment, the wireless signal is advertised by the access control 16 and detected by the mobile device 12. Once the mobile device 12 is detected within the zone of interest 310 a rate of a wireless signal advertised by at least one of the access control 16 and the mobile device 12 is increased. Once the mobile device 12 is detected within the zone of interest 310 a rate of wireless signal detection by at least one of the access control 16 and the mobile device 12 is increased.

At block 506, an access control 16 may be detected, which may be determined to be the final destination access control 16 that the individual carrying the mobile device 12 seeks to actuate. As the individual carrying the mobile device 12 enters a zone of interest 310, the final destination access control 16 that the individual intends to enter may be continuously estimated in real time based up various factors include past behavior, (i.e. frequently accessed access controls 16 at particular time), a schedule of the individual on the mobile device 12, and accessibility to access controls 16 (e.g., access controls 16 will get filtered out of an individual does not have access to the access control 16).

At block 508, the intent of the individual carrying the mobile device 12 to actuate the access control 16 is detected. Blocks 508 may be performed by the mobile device activity determination module 430, as described above. As mentioned above, the intent may be determined in response to detection of at least one of the position of the mobile device 12, the activity of the mobile device 12, and the calendar on the mobile device 12. In a first example, the intent of an individual carrying a mobile device to actuate a specific access control 16 may be determined if the mobile device 12 is detected proximate the specific access control 16. In a second example, the intent of an individual carrying a mobile device to actuate a specific access control 16 may be determined if the mobile device 12 has stopped moving or slowed proximate the specific access control 16. In a third example, the intent of an individual carrying a mobile device to actuate a specific access control 16 may be determined if a calendar of an individual carrying a mobile device shows a meeting associated with the specific access control 16. In a fourth example, the intent of an individual carrying a mobile device to not actuate a specific access control 16 may be determined if the mobile device 12 is detected to have walked past the specific access control 16. At block 510, the individual carrying the mobile device 12 is authenticated. As mentioned above, authentication may include: obtaining a credential from the mobile device 12; and verifying that the credential is authorized to actuate the access control 16. As also mentioned above, authentication may also include: detecting at least one of a voice signature and a verbal command from the individual carrying the mobile device 12; and verifying that individual is authorized to actuate the access control 16 in response to at least one of the voice signature and the verbal command. The voice signature and the verbal command may be checked against a data base of verified voice signatures and verbal commands to ensure authentication is correct. As also mentioned above, authentication may also include: capturing one or more visual images of the individual carrying the mobile device 12; and verifying that individual is authorized to actuate the access control 16 in response to the one or more visual images. The one or more images may depict at least one of a face of the individual carrying the mobile device 12 and a gait of the individual carrying the mobile device 12. The images may be checked against a data base of verified images to ensure authentication is correct.

At block 512, the access control 16 is actuated once the individual has been authenticated. In an embodiment, the access control 16 may be actuated near simultaneous to when the individual has been authenticated. In another embodiment, the access control 16 may be actuated only when the mobile device 12 is detected at a selected distance away from the access control 16, which advantageously avoids another individual from taking advantage of the authentication (e.g., opening the door and gaining access to room 208). In another embodiment, the individual may be authenticated first at block 510 and then once intent is determined at block 506, the access control 16 is actuated at block 512. Blocks 510 and 512 may be performed by the mobile device authentication module 430, as described above.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of actuating an access control using a mobile device, the method comprising:

detecting positional data of a mobile device carried by an individual;

detecting whether the mobile device is in a hand, a bag, a front pocket, or a back pocket of the individual;

applying a location offset to the positional data of the mobile device in response to the detecting whether the mobile device is in the hand, the bag, the front pocket, or the back pocket of the individual;

detecting that the mobile device is located within a zone of interest in response to the positional data of the mobile device;

detecting an access control;

detecting intent of the individual carrying the mobile device to actuate the access control;

authenticating the individual carrying the mobile device; and actuating the access control once the individual has been authenticated, wherein authenticating the individual carrying the mobile device further comprises at least:

obtaining an access timing history of the individual carrying the mobile device; and verifying that individual is authorized to actuate the access control based on the access timing history, wherein the access timing history depicts a time of day that the individual has historically accessed the access control.

2. The method of claim 1, further comprising:

increasing a rate of a wireless signal advertised by at least one of the access control and the mobile device when the mobile device is detected within the zone of interest.

3. The method of claim 1, further comprising:

increasing a rate of wireless signal detection by at least one of the access control and the mobile device when the mobile device is detected within the zone of interest.

4. The method of claim 2, further comprising:

increasing a rate of wireless signal detection by at least one of the access control and the mobile device when the mobile device is detected within the zone of interest.

5. The method of claim 1, wherein detecting intent of the individual carrying the mobile device to actuate an access control further comprises:

detecting at least one of a position of the mobile device, an activity of the mobile device, and a calendar on the mobile device; and determining intent of the individual in response to at least one of the position of the mobile device, the activity of the mobile device, and the calendar on the mobile device.

6. The method of claim 1, wherein authenticating the individual carrying the mobile device further comprises:

obtaining a credential from the mobile device; and verifying that the credential is authorized to actuate the access control.

7. The method of claim 1, wherein authenticating the individual carrying the mobile device further comprises:

detecting at least one of a voice signature and a verbal command from the individual carrying the mobile device; and verifying that individual is authorized to actuate the access control in response to at least one of the voice signature and the verbal command.

8. The method of claim 1, wherein authenticating the individual carrying the mobile device further comprises:

capturing one or more visual images of the individual carrying the mobile device; and verifying that individual is authorized to actuate the access control in response to the one or more visual images.

9. The method of claim 8, wherein the one or more images depict at least one of a face of the individual carrying the mobile device and a gait of the individual carrying the mobile device.

10. The method of claim 1, wherein the detecting positional data of a mobile device further comprises:

determining a distance between the mobile device and the access control in response to a signal strength of a wireless signal advertised by at least one of the mobile device and the access control.

11. A computer program product tangibly embodied on a non-transitory computer readable medium, the computer program product including instructions that, when executed by a processor, cause the processor to perform operations comprising:

detecting positional data of a mobile device carried by an individual;

detecting whether the mobile device is in a hand, a bag, a front pocket, or a back pocket of the individual;

applying a location offset to the positional data of the mobile device in response to the detecting whether the mobile device is in the hand, the bag, the front pocket, or the back pocket of the individual;

detecting that the mobile device is located within a zone of interest in response to the positional data of the mobile device;

detecting an access control;

detecting intent of the individual carrying the mobile device to actuate the access control;

authenticating the individual carrying the mobile device; and actuating the access control once the individual has been authenticated, wherein authenticating the individual carrying the mobile device further comprises at least:

obtaining an access timing history of the individual carrying the mobile device; and verifying that individual is authorized to actuate the access control based on the access timing history, wherein the access timing history depicts a time of day that the individual has historically accessed the access control.

12. The computer program product of claim 11, wherein the operations further comprise:

increasing a rate of a wireless signal advertised by at least one of the access control and the mobile device when the mobile device is detected within the zone of interest.

13. The computer program product of claim 11, wherein the operations further comprise:

increasing a rate of wireless signal detection by at least one of the access control and the mobile device when the mobile device is detected within the zone of interest.

14. The computer program product of claim 12, wherein the operations further comprise:

increasing a rate of wireless signal detection by at least one of the access control and the mobile device when the mobile device is detected within the zone of interest.

15. The computer program product of claim 11, wherein detecting intent of the individual carrying the mobile device to actuate an access control further comprises:

detecting at least one of a position of the mobile device, an activity of the mobile device, and a calendar on the mobile device; and determining intent of the individual in response to at least one of the position of the mobile device, the activity of the mobile device, and the calendar on the mobile device.

16. The computer program product of claim 11, wherein authenticating the individual carrying the mobile device further comprises:

obtaining a credential from the mobile device; and verifying that the credential is authorized to actuate the access control.

17. The computer program product of claim 11, wherein authenticating the individual carrying the mobile device further comprises:

detecting at least one of a voice signature and a verbal command from the individual carrying the mobile device; and verifying that individual is authorized to actuate the access control in response to at least one of the voice signature and the verbal command.

18. The computer program product of claim 11, wherein authenticating the individual carrying the mobile device further comprises:

capturing one or more visual images of the individual carrying the mobile device; and verifying that individual is authorized to actuate the access control in response to the one or more visual images.

19. The computer program product of claim 18, wherein the one or more images depict at least one of a face of the individual carrying the mobile device and a gait of the individual carrying the mobile device.

20. The computer program product of claim 11, wherein the detecting positional data of a mobile device further comprises:

determining a distance between the mobile device and the access control in response to a signal strength of a wireless signal advertised by at least one of the mobile device and the access control.

* * * * *